United States Patent [19]

Shenoy

[11] Patent Number: 4,564,282

[45] Date of Patent: Jan. 14, 1986

[54] CORONA CHARGING DEVICE

[75] Inventor: Vittal U. Shenoy, Fairport, N.Y.

[73] Assignee: Xerox Corporation, Stamford, Conn.

[21] Appl. No.: 441,356

[22] Filed: Nov. 15, 1982

[51] Int. Cl.[4] ..... G03G 15/02; H01T 19/00

[52] U.S. Cl. ..... 355/3 CH; 250/324; 355/14 CH; 361/235

[58] Field of Search ..... 355/3 R, 3 CH, 14 CH; 250/324, 325, 326; 361/229, 235

[56] References Cited

U.S. PATENT DOCUMENTS

| | | | |
|---|---|---|---|
| 3,660,656 | 5/1972 | Frank et al. | 361/229 X |
| 3,813,548 | 5/1974 | Silverberg | 250/324 |
| 3,819,942 | 6/1974 | Hastwell et al. | 250/324 |
| 4,086,650 | 4/1978 | Davis et al. | 361/229 |
| 4,140,962 | 2/1979 | Quinn | 250/326 X |
| 4,190,348 | 2/1980 | Friday | 250/325 X |
| 4,265,990 | 5/1981 | Stalka et al. | 430/59 |
| 4,339,783 | 7/1982 | Kinashi et al. | 250/326 X |
| 4,355,884 | 10/1982 | Honda et al. | 355/3 CH X |

*Primary Examiner*—Fred L. Braun

[57] ABSTRACT

A self-biasing corona discharge device, for example, a dicorotron, which is suitable for use in conditioning the residual toner on a charge retentive surface such as a photoreceptor to thereby facilitate subsequent toner removal therefrom. The foregoing device is utilized in conjunction with a self-biasing detack corona device suitable for use in reducing electrostatic attraction between the copy substrate and the photoreceptor. The self-biasing arrangement used for conditioning the residual toner enables sufficient shield current to be generated to effect the preclean (i.e. residual toner conditioning prior to cleaning) function. The biasing arrangement used in the corona device for conditioning the residual toner is also utilized in connection with the charge and transfer coronode devices thereby permitting all of the corona devices to be powered by a single secondary winding of the power source at reduced power.

1 Claim, 6 Drawing Figures

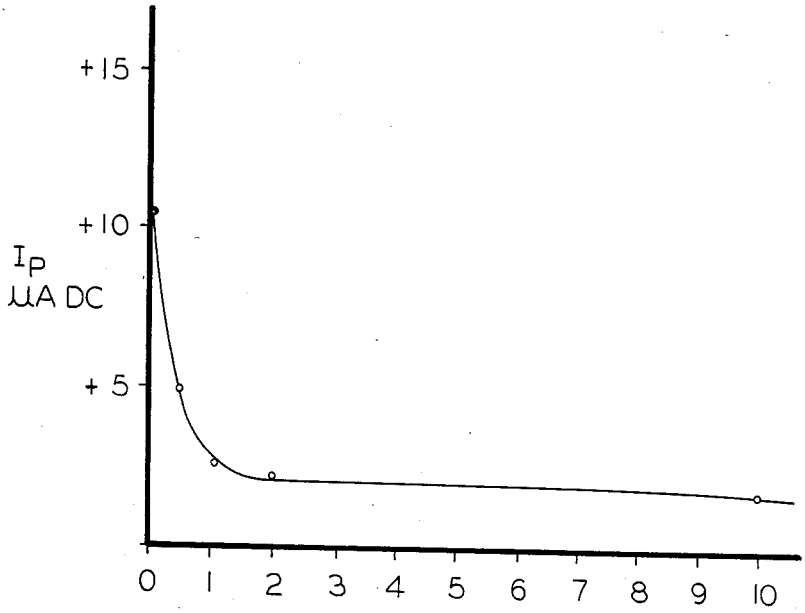
FIG. 3 $R_S$ MEGOHMS
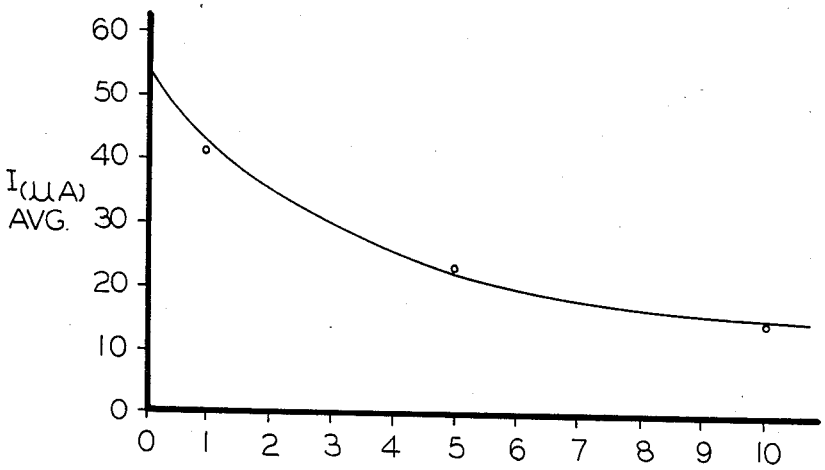
FIG. 4 $R_S$ (MEGOHMS)

CORONA CHARGING DEVICE

This invention relates, in general, to machines utilizing the xerographic or similar process for reproducing information. In particular, this invention relates to an improved corona devices for use in the xerographic process.

As is well known, the xerographic process utilizes corona discharge devices for placing a uniform electrostatic charge on a photoreceptor, for transferring toner images to a copy substrate from the photoreceptor, for detacking the copy substrate from the photoreceptor and for treating the residual toner in preparation for its removal from the photoreceptor. From the standpoint of cost reductions and producing a less complex machine, it is desirable to minimize the number of power supplies used in connection with these corona devices. To this end, the commonly used power supply used for biasing a detack corona device can be eliminated by rendering the dicorotron self-biasing by connecting the conductive shield thereof to ground via an impedance device such as a resistor. Such an arrangement is disclosed in U.S. Pat. No. 4,449,808 filed in the name of Abreu and assigned to the same assignee as this application.

A dicorotron as disclosed in U.S. Pat. No. 4,086,650 comprises a coronode having a conductive wire which is coated with an electrically insulating material, the thickness of the coating being such that with a source of a.c. power applied to the coronode substantially no net d.c. current flows in the wire. Thus, when the conductive shield forming a part of the dicorotron and the photoreceptor passing under the dicorotron are at the same potential no current flows to the photoreceptor or to the conductive shield. However, when the shield and photoreceptor are at different potentials, for example, when there is a copy sheet attached to the photoreceptor to which toner images have been electrostatically transferred from the photoreceptor an electrostatic field is established between the shield and the photoreceptor which causes current to flow in the shield circuit to ground through, in the case of the aforementioned application, a resistor. At the same time, current of equal magnitude but opposite in polarity flows to the photoreceptor. The amount of current is a function of the potential difference between the shield and photoreceptor. Therefore, if the potential difference is large, the current flow is greater than if the difference is small. Through proper selection of the resistance value of the resistor, the desired current flow through the shield circuit and thus to the photoreceptor is obtained.

Attempts at utilizing the foregoing described detack arrangement for the preclean function produced 10.5 microamps of d.c. current maximum as compared to a current of 30 to 40 microamps of d.c. current when used for detack. This is because the photoreceptor charge level upon entering the preclean station is not only low but it may also be of both positive and negative polarities. The current (i.e. 30 to 40 microamps required for preclean) cannot be achieved using the foregoing biasing arrangement.

Accordingly, by the present invention there has been provided an improved corona device which can be utilized for the preclean (i.e. treatment of the residual toner on the photoreceptor to facilitate removal thereof) function which does not require a power supply for biasing a pre-clean corotron. To this end, I have utilized a current rectifying element such as a diode in the shield circuit of my pre-clean corona device. Thus, the conductive shield is connected through ground via the diode and an impedance device such as a resistor similar to the one used in the detack corona device of the aforementioned Abreu application. The diode allows only half the a.c. current flow through the shield circuit while blocking current flow in the opposite direction. The substantially higher average current obtained in this manner is sufficiently large to accomplish the pre-clean function.

The same shield biasing circuit is used for the charge and transfer functions but are not for self-biasing because the current requirements for charge and transfer are much too high. The shield circuit including a resistor and a diode is used for biasing the voltage applied to the charge and transfer shields. A single secondary winding of the power source is used for all of the corona devices and at reduced power than otherwise possible.

For a general understanding of the features of the present invention, a description thereof will be made with reference to the drawings wherein:

FIG. 1 schematically depicts the various components of an illustrative electrophotographic machine incorporating the apparatus and method of the present invention;

Figure 3A:
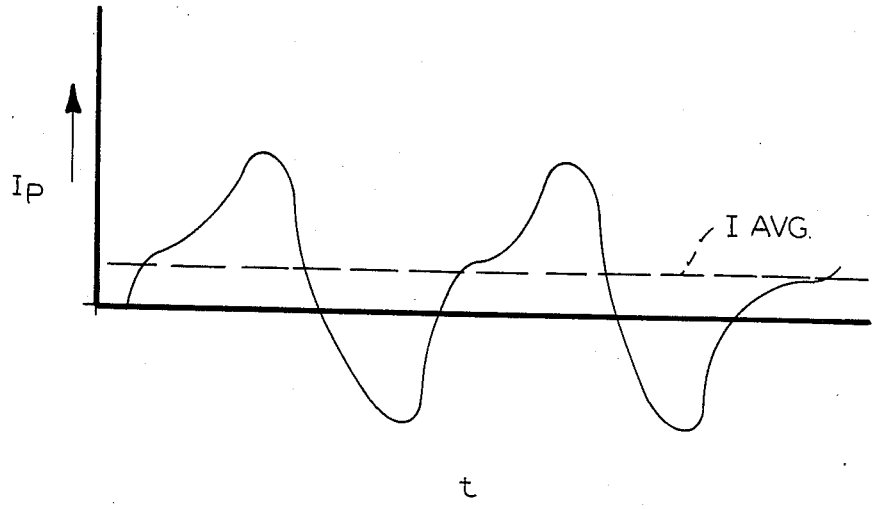
FIG. 3 is a plot of d.c. plate, current versus different resistance values for a corona device not utilizing the invention.
Figure 4B:
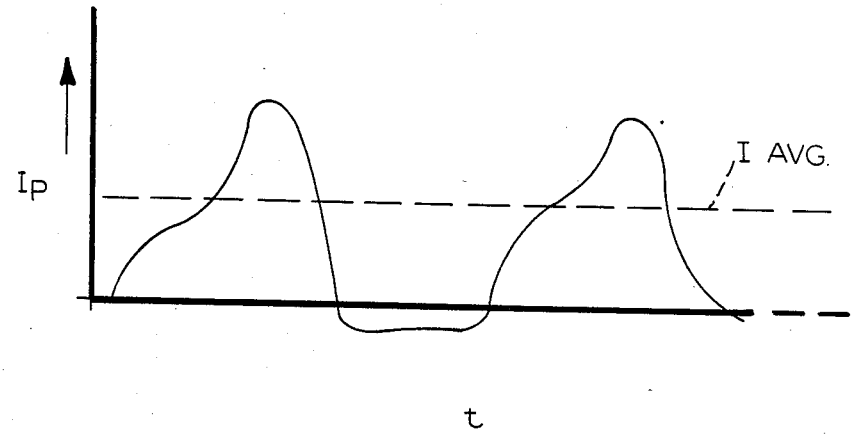

FIG. 3*a* is a plot of plate current versus time illustrating the average current for a device not incorporating the present invention;

FIG. 4 is a plot of d.c. plate current versus different resistance values for a corona device incorporating the present invention; and FIG. 4*a* is a plot of plate current versus time illustrating the increased average current due to the incorporation of the present invention.

Inasmuch as the art of electrophotography is well known, the various processing stations employed in the printing machine illustrated in the FIG. 1 will be described only briefly.

Figure 1:
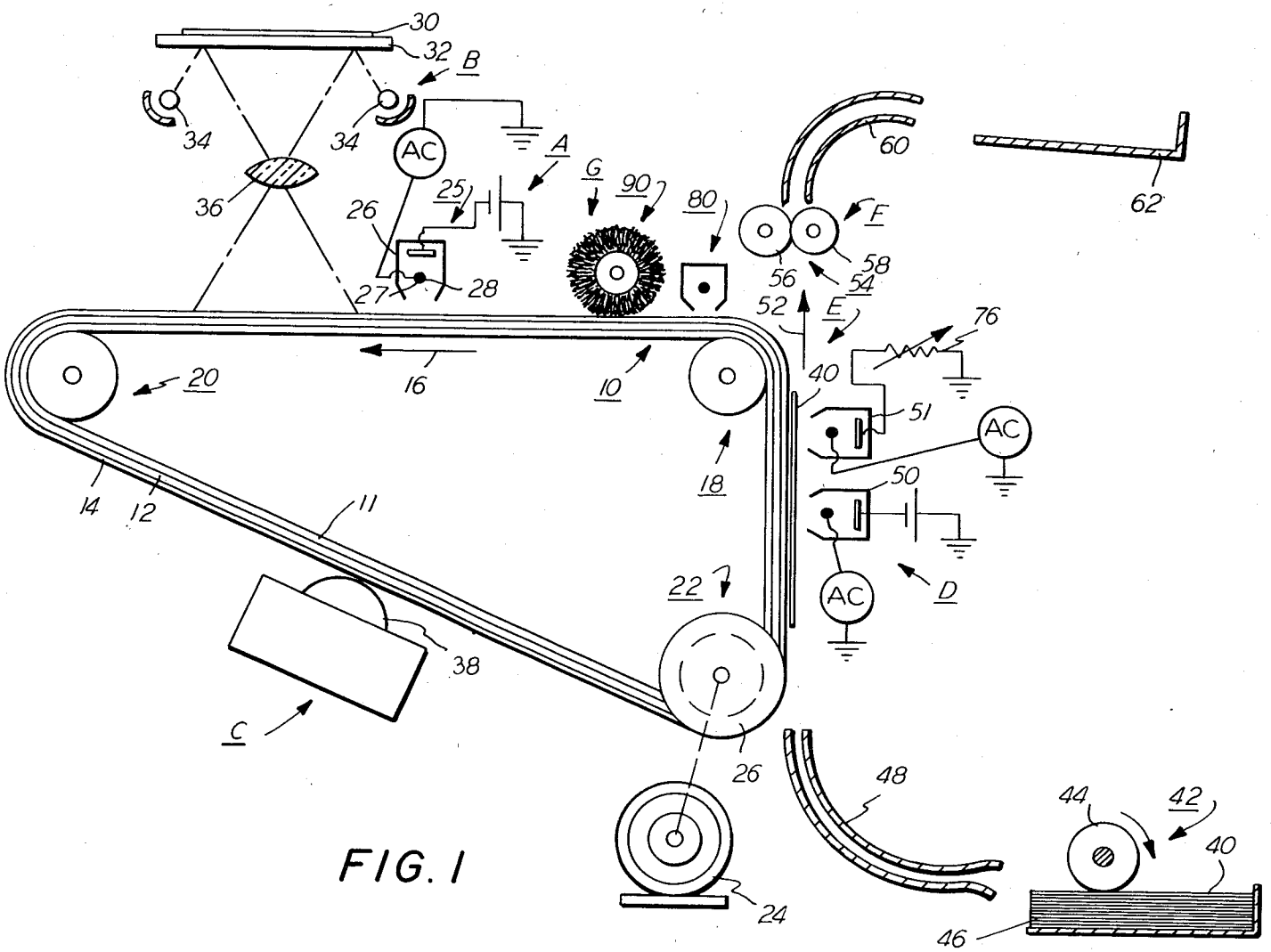

As shown in FIG. 1, the machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photorecptor of this type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as belt drive.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, charges the belt 10 to a relatively high, substantially uniform negative potential. A suitable corona generating device for negatively charging the photoconductive belt 10 comprises a conductive shield 26 and a dicorotron electrode comprising an elongated bare wire 27 and a relatively thick electrically insulating layer 28 having a thickness which precludes a net d.c. corona current when an a.c. voltage is applied to the corona wire and when the shield and the photoconductive surface are at the same potential. Stated differently, in the absence of an external field supplied by either a bias applied to the shield or a charge on the photoreceptor there is substantially no net d.c. current flow.

Next, the charged portion of photoconductive belt is advanced through exposure station B. At exposure station B, an original document 30 is positioned facedown upon transparent platen 32. Lamps 34 flash light rays onto original document 30. The light rays reflected from original document 30 form light images which are transmitted through lens 36. The light images are projected onto the charged portion of the photoconductive belt to selectively dissipate the charge thereon. This records an electrostatic latent image on the belt which corresponds to the informational area contained within original document 30. Alternatively, the exposure station B could contain an electrographic recording device for placing electrostatic images on the belt 10 in which case, the corona device 25 would be unnecessary.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoconductive belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays negative ions onto the backside of sheet 40 so that the toner powder images which comprise positive toner particles are attracted from photoconductive belt 10 to sheet 40. For this purpose, approximately 50 microamperes of negative current flow to the copy sheet is effected by the application of a suitable corona generating voltage and proper bias.

Subsequent to transfer the image sheet moves past a detack corona generating device 51 positioned at a detack station E. At the detack station the charges placed on the backside of the copy sheet during transfer are partially neutralized. The partial neutralization of the charges on the backside of the copy sheet reduces the bonding forces holding it to the belt 10 thus enabling the sheet to be stripped as the belt moves around the rather sharp bend in the belt provided by the roller 18. After detack, the sheet continues to move in the direction of arrow 52 onto a conveyor (not shown) which advances the sheet to fusing station F.

Fusing station F includes a fuser assembly, indicated generally by the reference numeral 54, which permanently affixes the transferred toner powder images to sheet 40. Preferably, fuser assembly 54 includes a heated fuser roller 56 adapted to be pressure engaged with a backup roller 58. Sheet 40 passes between fuser roller 56 and backup roller 58 with the toner powder images contacting fuser roller 56. In this manner, the toner powder image is permanently affixed to sheet 40. After fusing chute 60 guides the advancing sheet 40 to catch tray 62 for removal from the printing machine by the operator.

The dicorotron structures (FIG. 2) are the same for all of the corona devices but the voltages and biases and methods of applying them are different. In the case of the detack corona device 51 an a.c. voltage is applied to the dicorotron electrode with the shield connected to ground through an impedance such as a resistor 76. With such an arrangement, when the photoconductive surface with the sheet 40 adhered thereto through electrostatic bonds resulting from the transfer operation, moves through the detack station, the charges contained on the backside of the sheet 40 establish a relatively large electrostatic field between the shield and the copy sheet. This field causes current to flow between the dicorotron electrode and the backside of the copy sheet and between the dicorotron electrode and the shield. Thus, a current flows through the resistor 76 which developes a voltage across it which is the desired shield bias voltage.

Thus, the negatively charged paper passing under the detack dicorotron acts as a current source which due to the relatively large charge on the paper is able to supply between 30 to 40 microamps of d.c. current which by the proper selection of the value of the resistor 76 supplies the required detack current. Attempts at using the type of biasing used for the detack corotron for the preclean function did not furnish enough current to perform the preclean function. This is because the charge level on the photoreceptor when it passes under the preclean dicorotron is inadequate for such purposes. As can be seen in FIG. 3 (i.e. a plot of current delivered to the photoreceptor vs. different values for the resistor 76) the maximum current when using the detack structure for preclean is only about 10 microamps.

In accordance with the pesent invention, in order to eliminate the need for a d.c. bias power supply for the preclean dicorotron as well as for the detack corotron, a diode 78 is provided in the shield circuit of a preclean dicorotron 80 (FIG. 2) comprising a coronode 82 which is capacitively coupled via capacitor 83 to the secondary winding 84 of an a.c. power source (not shown), the diode being in series with a variable resistor 86 through which a shield 88 is connected to ground. The diode allows only half the a.c. current flowing in the coronode circuit to flow through the shield circuit while blocking current flow through the shield in the opposite direction. The substantially higher average current obtained in this manner is sufficiently large to accomplish the preclean function. As can be seen from FIG. 4 (i.e.

plot of d.c. current delivered to the photoreceptor vs. various resistance values for resistor 86) the average current flow with the diode in the shield circuit is substantially higher than shown in FIG. 3 (i.e. shield circuit without diode).

The preclean dicorotron 80 functions to partially neutralize residual charge remaining on the drum surface after transfer and also reduces the electrostatic bond holding the residual toner to the drum, thereby, aiding in the removal of the toner by means of a conventional cleaning brush 90 disposed at cleaning station G.

While it was discovered that adequate current flow could be obtained for the detack and preclean functions through self-biasing as discussed, due to the much higher current requirements for the charge and transfer functions self-biasing in that manner is not feasible. As disclosed in FIG. 2 each of the four xerographic functions utilizing a corona device derives it power from a single secondary winding (i.e. winding 84) of an a.c. power supply. As mentioned it is not feasible to derive large enough shield biases for the charge and transfer functions in the manner used for preclean and detack, therefore, biases are provided via the secondary winding 84. To this end, shields 90 and 92 of the charge and transfer dicorotrons 25 and 50 are capacitively coupled to the winding 84 via capacitors 94 and 96. While the a.c. power supply could be made large enough to provide sufficient shield current in this manner it is not desirable to do so due to the waste of power. Accordingly, the self-biasing scheme utilized in connection with the preclean corona device is used as a hard bias to reduce the power requirements of the a.c. power supply.

Figure 2:
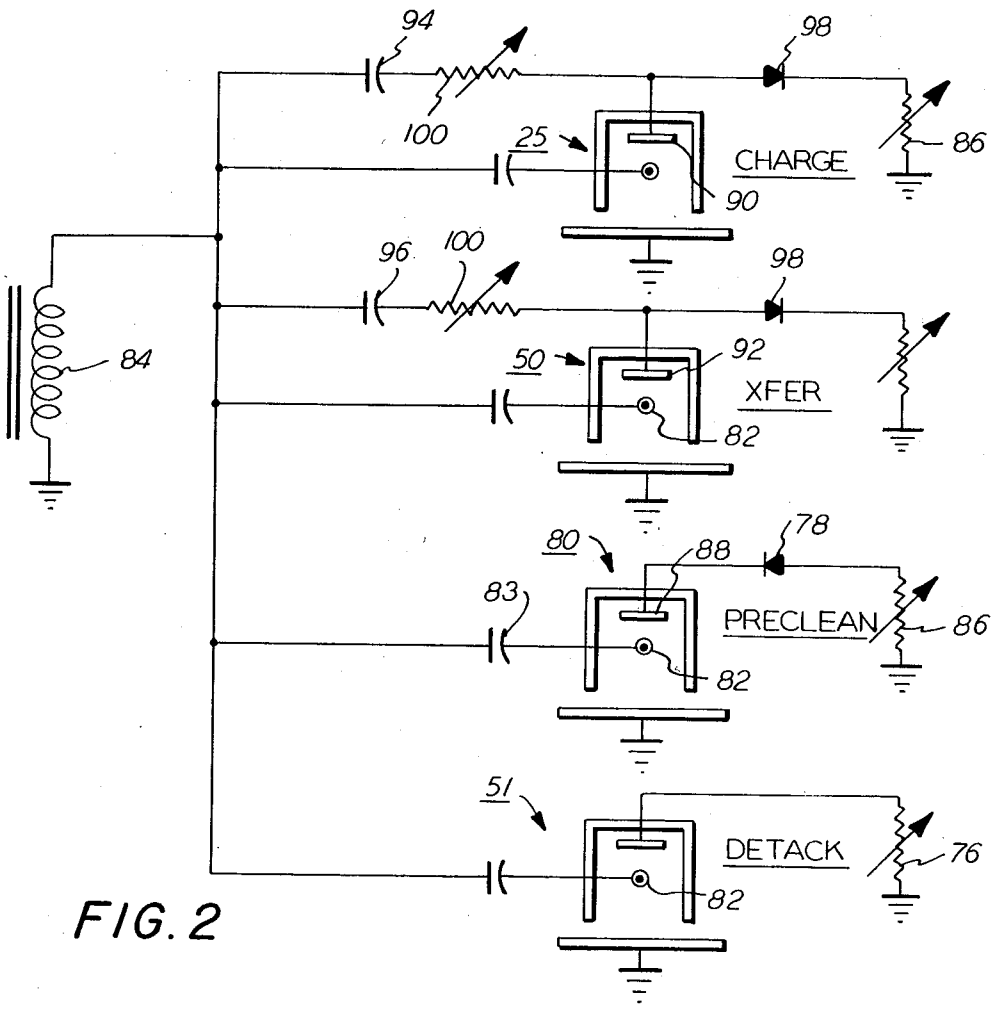
FIG. 2 is a schematic illustration of the corona devices utilized in the machine of FIG. 1 invention.

As illustrated in FIG. 2, diodes 98 connected in series with variable resistors 86 operatively couple shields 90 and 92 to ground. Thus, these components provide the biases of desired polarity in the case of the charge and transfer corona devices. A variable resistor 100 is used in the circuits connecting the secondary winding 84 to the shields 90 and 92. The purpose of the resistors is to effect a phase shift between the voltages applied to the shield and coronode of each corona device so that the electrostatic field therebetween doesn't collapse.

The corona wires may be supported in conventional fashion at the ends thereof by insulating end blocks (not shown) mounted within the ends of the shield structure. The wire may be made of any conventional conductive filament material such as stainless steel, gold, aluminum, copper, tungsten, platinum or the like. The diameter of the wire 11 is not critical and may vary typically between 0.5–15 mil and preferably is about 3–6 mils.

Any suitable dielectric material may be employed as the insulative coating which will not break down under the applied corona a.c. voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

The thickness of the dielectric coating used in the corona device of the invention is such that when an a.c. voltage is applied to the wire and with the photoconductive surface and the shield at the same potential substantially no conduction current or d.c. charging current is permitted therethrough. Typically, the thickness is such that the combined wire and dielectric thickness falls in the range from 10–30 mil with a typical dielectric thickness of 2–10 mil. Glasses with dielectric breakdown strengths above 5 KV/mm have been found by experiment to perform satisfactorily as the dielectric coating material. The glass coating selected should be free of voids and inclusions and make good contact with or wet the wire on which it is deposited. Other possible coatings are ceramic materials such as alumina, zirconia, boron nitride, beryllium oxide and silicon nitride. Organic dielectrics which are sufficiently stable in corona may also be used.

I claim:

1. Xerographic reproducing apparatus, said apparatus comprising:

means for forming a powder image on a charge retentive surface and transferring the image to a substrate;

means for assisting in the removal of said substrate from said surface, said means comprising a corona device including an electrode and a conductive shield which is self-biased by means of a resistor through which the shield is connected to ground;

a preclean corona device comprising an electrode having an insulative coating and a conductive shield;

means for applying a.c. power to said preclean electrode, said insulative coating being thick enough to substantially preclude net d.c. current flow from said preclean electrode; and a self-biasing electrical circuit connecting said conductive shield of said preclean corona to ground, said circuit including means to cause sufficient current to flow in said circuit for effecting substantial neutralization of charged residual toner electrostatically adhered to said charge retentive surface when said surface with said charged residual toner is moved past said preclean electrode and a.c. power is applied to said preclean electrode;

corona devices for uniformly electrostatically charging said charge retentive surface and electrostatically transferring toner images to said substrate, each of said corona devices for charging and transferring comprising a conductive shield and an electrode;

said means for applying a.c. power comprising a single secondary winding and all of said electrodes being operatively connected thereto; and said shields of said corona devices for charging said charge retentive surface and transferring toner images being partially self-biased and partially biased via said secondary winding.

* * * * *